US008221696B2

(12) United States Patent
Brandt et al.

(10) Patent No.: US 8,221,696 B2
(45) Date of Patent: Jul. 17, 2012

(54) DETERGENT DISPENSING DEVICE

(75) Inventors: Guido Brandt, Mt Waverley (AU); Thomas Enkel, Ellerstadt (DE); Karl-Ludwig Gibis, Ludwigshafen (DE); Michael Hahl, Bern (CH); Chris Efstathios Housmekerides, Ludwigshafen (DE); Brendyn Rodgers, Mt Waverley (AU)

(73) Assignee: Reckitt Benckiser N.V., WT Hoofddorp (NL)

( * ) Notice: Subject to any disclaimer, the term of this patent is extended or adjusted under 35 U.S.C. 154(b) by 556 days.

(21) Appl. No.: 11/573,748

(22) PCT Filed: Aug. 22, 2005

(86) PCT No.: PCT/GB2005/003259

§ 371 (c)(1),
(2), (4) Date: Jan. 4, 2008

(87) PCT Pub. No.: WO2006/021761

PCT Pub. Date: Mar. 2, 2006

(65) Prior Publication Data

US 2008/0308570 A1 Dec. 18, 2008

(30) Foreign Application Priority Data

Aug. 23, 2004 (GB) ..... 0418760.5
Feb. 22, 2005 (GB) ..... 0503573.8
Apr. 5, 2005 (GB) ..... 0506812.7

(51) Int. Cl.

| | |
|---|---|
| ***B01D 11/02*** | (2006.01) |
| ***B01D 12/00*** | (2006.01) |
| ***B01D 15/00*** | (2006.01) |
| ***D06F 29/00*** | (2006.01) |
| ***D06F 35/00*** | (2006.01) |

(52) U.S. Cl. ..... 422/261; 68/17 R

(58) Field of Classification Search ..... 68/17 R; 422/261

See application file for complete search history.

(56) References Cited

U.S. PATENT DOCUMENTS 2,315,890 A 4/1943 Bader (Continued)

FOREIGN PATENT DOCUMENTS

CA 2313356 A1 1/2001

(Continued)

OTHER PUBLICATIONS

Search Report from The Patent Office in Great Britain dated Jul. 14, 2005 for application GB 0503573.8.

(Continued)

*Primary Examiner* — Walter D Griffin
*Assistant Examiner* — Christopher Vandeusen
(74) *Attorney, Agent, or Firm* — Norris McLaughlin & Marcus PA

(57) ABSTRACT

A detergent dispensing device for an automatic washing machine has a cartridge, a selecting mechanism, an operating mechanism, and a thermal element. The cartridge includes a plurality of chambers to accommodate a detergent composition. The selecting mechanism selectively exposes each chamber to wash liquor allowing the detergent, in use, to be washed out of the chamber. The operating mechanism is movable from a first position to a second position for loading mechanical energy into the device which provides a restoring force for the operating mechanism. The thermal element retains the operating means in the second position and is arranged to move when subjected to an elevated temperature prevailing in an interior of the washing machine during a wash cycle, thereby the thermal element moves or releases the operating mechanism. The operating mechanism is arranged to advance the selecting mechanism to an adjacent chamber as the cartridge remains stationary.

29 Claims, 10 Drawing Sheets

U.S. PATENT DOCUMENTS

Figure 1A:
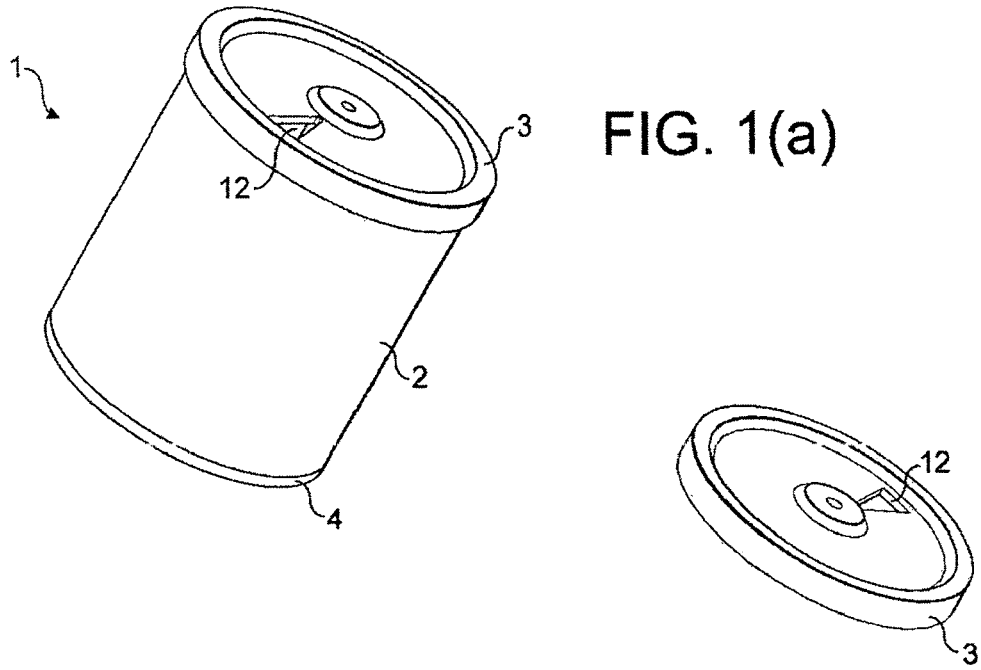

| | | | | |
|---|---|---|---|---|
| 2,370,609 | A | 2/1945 | Wilson | |
| 2,514,000 | A | 7/1950 | Kent | |
| 2,777,570 | A | 1/1957 | Mytinger | |
| 2,880,077 | A | 3/1959 | Floria | |
| 2,954,145 | A | 9/1960 | McCauley | |
| 3,063,459 | A | 11/1962 | Jacobs | |
| 3,091,402 | A | 5/1963 | Palmer | |
| 3,187,767 | A | 6/1965 | Sherrard | |
| 3,272,899 | A | 9/1966 | Diamond et al. | |
| 3,411,671 | A | 11/1968 | Harvey et al. | |
| 3,482,740 | A | 12/1969 | Evans et al. | |
| 3,759,284 | A | 9/1973 | Crowley et al. | |
| 3,822,561 | A | 7/1974 | Miller | |
| 4,055,278 | A | 10/1977 | Seymour | |
| D269,801 | S | 7/1983 | Sangster et al. | |
| 4,416,859 | A * | 11/1983 | Brown et al. | 422/261 |
| D273,033 | S | 3/1984 | Sangster et al. | |
| D280,757 | S | 9/1985 | Paulovich et al. | |
| 4,545,917 | A | 10/1985 | Smith et al. | |
| 4,700,554 | A | 10/1987 | Eichman et al. | |
| 4,835,804 | A | 6/1989 | Arnau-Munoz et al. | |
| D304,102 | S | 10/1989 | Lakhan et al. | |
| 4,917,272 | A | 4/1990 | Ikeda | |
| D308,739 | S | 6/1990 | Nystuen | |
| 4,999,124 | A | 3/1991 | Copeland | |
| 5,033,643 | A | 7/1991 | Schumacher | |
| D328,332 | S | 7/1992 | Fink | |
| D328,333 | S | 7/1992 | Casberg | |
| 5,137,694 | A | 8/1992 | Copeland et al. | |
| 5,186,912 | A | 2/1993 | Steindorf et al. | |
| D346,890 | S | 5/1994 | Panesar | |
| 5,310,430 | A | 5/1994 | McCall | |
| 5,474,211 | A | 12/1995 | Hellenberg | |
| 5,500,050 | A | 3/1996 | Chan | |
| D376,320 | S | 12/1996 | Lathrop et al. | |
| 5,603,233 | A | 2/1997 | Erickson | |
| D381,141 | S | 7/1997 | Balz | |
| D383,264 | S | 9/1997 | Balz | |
| 5,679,173 | A | 10/1997 | Hartman | |
| 5,681,400 | A | 10/1997 | Brady et al. | |
| 5,807,906 | A | 9/1998 | Bonvallot et al. | |
| 5,870,906 | A | 2/1999 | Denisar | |
| 5,967,158 | A | 10/1999 | Smith et al. | |
| 5,971,154 | A | 10/1999 | Toren | |
| 6,048,501 | A | 4/2000 | Lemaire et al. | |
| 6,058,946 | A | 5/2000 | Bellati et al. | |
| 6,173,743 | B1 | 1/2001 | Ibanez Sapina | |
| 6,178,987 | B1 | 1/2001 | Caruthers, Jr. et al. | |
| 6,263,708 | B1 | 7/2001 | Yarmosky | |
| D457,596 | S | 5/2002 | Guzman et al. | |
| 6,463,766 | B2 * | 10/2002 | Kubota et al. | 68/12.18 |
| D465,258 | S | 11/2002 | Hiranaga et al. | |
| 6,571,993 | B2 | 6/2003 | Rodd et al. | |
| 6,581,800 | B2 * | 6/2003 | Rodd et al. | 222/54 |
| 6,608,022 | B1 | 8/2003 | Zabarylo et al. | |
| D481,844 | S | 11/2003 | Greene et al. | |
| 6,681,963 | B2 | 1/2004 | Hague et al. | |
| D513,928 | S | 1/2006 | Birdsell et al. | |
| D526,043 | S | 8/2006 | Thompson | |
| D529,128 | S | 9/2006 | Lee | |
| D539,993 | S | 4/2007 | Brandt | |
| 7,219,518 | B2 * | 5/2007 | Aouad et al. | 68/17 R |
| D547,912 | S | 7/2007 | Brandt | |
| 7,276,470 | B2 | 10/2007 | Hahn | |
| D564,141 | S | 3/2008 | Gaa et al. | |
| D564,142 | S | 3/2008 | Gaa et al. | |
| D564,143 | S | 3/2008 | Gaa et al. | |
| D568,555 | S | 5/2008 | Gaa et al. | |
| 7,421,867 | B2 * | 9/2008 | Bongini | 68/17 R |
| 7,428,831 | B2 | 9/2008 | Cho et al. | |
| D601,766 | S | 10/2009 | Gaa et al. | |
| D604,466 | S | 11/2009 | Gaa et al. | |
| D608,960 | S | 1/2010 | Gaa et al. | |
| 2001/0010165 | A1 | 8/2001 | Kubota et al. | |
| 2002/0108969 | A1 | 8/2002 | Rodd et al. | |
| 2002/0117187 | A1 | 8/2002 | Helminger | |
| 2002/0169092 | A1 | 11/2002 | Catlin et al. | |
| 2003/0052138 | A1 | 3/2003 | Smith | |
| 2003/0168085 | A1 | 9/2003 | Sowle et al. | |
| 2003/0182732 | A1 | 10/2003 | Davenet et al. | |
| 2004/0088796 | A1 | 5/2004 | Neergaard et al. | |
| 2004/0103925 | A1 | 6/2004 | Marettek | |
| 2004/0206133 | A1 | 10/2004 | Woo et al. | |
| 2004/0216499 | A1 | 11/2004 | Bongini | |
| 2005/0039781 | A1 | 2/2005 | Song et al. | |
| 2005/0109860 | A1 | 5/2005 | Chiang et al. | |
| 2005/0121058 | A1 | 6/2005 | Furber et al. | |
| 2005/0139241 | A1 | 6/2005 | Jowett et al. | |
| 2005/0148497 | A1 | 7/2005 | Khan | |
| 2005/0235704 | A1 * | 10/2005 | Cho et al. | 68/112 |
| 2006/0258556 | A1 | 11/2006 | Holderbaum et al. | |
| 2007/0000068 | A1 | 1/2007 | Gerad France et al. | |
| 2007/0295036 | A1 | 12/2007 | Brandt et al. | |
| 2008/0053187 | A1 | 3/2008 | Koring | |
| 2008/0053494 | A1 | 3/2008 | Moro et al. | |

FOREIGN PATENT DOCUMENTS

| | | | |
|---|---|---|---|
| DE | 2244722 | | 10/1973 |
| DE | 2244722 | A1 | 10/1973 |
| DE | 4400417 | A1 | 7/1995 |
| DE | 19516312 | C1 | 8/1996 |
| DE | 19540608 | | 5/1997 |
| DE | 19652733 | A1 | 6/1998 |
| DE | 19740819 | A1 | 3/1999 |
| DE | 19740819 | | 5/1999 |
| DE | 19836857 | | 2/2000 |
| DE | 19930771 | A1 | 1/2001 |
| EP | 0 457 137 | | 5/1991 |
| EP | 0481547 | | 4/1992 |
| EP | 0521179 | | 1/1993 |
| EP | 0906747 | | 4/1999 |
| EP | 0906747 | A | 4/1999 |
| FR | 2723751 | A1 | 2/1996 |
| FR | 2723752 | | 2/1996 |
| GB | 820327 | | 9/1959 |
| GB | 1142238 | | 2/1969 |
| GB | 1198251 | | 7/1970 |
| GB | 2037719 | A | 7/1980 |
| GB | 1592357 | | 7/1981 |
| GB | 1592357 | A | 7/1981 |
| GB | 2104109 | A | 3/1983 |
| GB | 2244722 | A | 12/1991 |
| GB | 2339678 | | 2/2000 |
| GB | 2356842 | | 6/2001 |
| GB | 2386129 | | 9/2003 |
| GB | 2386129 | A | 9/2003 |
| GB | 2386130 | A | 9/2003 |
| GB | 2402604 | A | 12/2004 |
| GB | 2402679 | | 12/2004 |
| GB | 2406821 | A | 4/2005 |
| GB | 2417492 | A | 3/2006 |
| JP | 2000317350 | A | 11/2000 |
| JP | 2003260130 | A | 9/2003 |
| JP | 2006 061450 | | 3/2006 |
| JP | 2006122196 | A | 5/2006 |
| WO | 88/06199 | A | 8/1988 |
| WO | 8806199 | A1 | 8/1988 |
| WO | 96 38638 | | 12/1996 |
| WO | 9712539 | | 4/1997 |
| WO | 01 07702 | A1 | 2/2001 |
| WO | 01/07703 | A1 | 2/2001 |
| WO | 0107703 | A1 | 2/2001 |
| WO | 0178572 | A2 | 10/2001 |
| WO | 02/20893 | A | 3/2002 |
| WO | 02 076278 | | 3/2002 |
| WO | 0220893 | A | 3/2002 |
| WO | 02 058528 | A1 | 8/2002 |
| WO | 03 073906 | | 9/2003 |
| WO | 03/073906 | A1 | 9/2003 |
| WO | 03/073907 | A2 | 9/2003 |
| WO | 03073907 | A2 | 9/2003 |
| WO | 2004 033297 | | 4/2004 |
| WO | 2004/044303 | A | 5/2004 |
| WO | 2004041248 | | 5/2004 |
| WO | 2004044303 | A | 5/2004 |
| WO | 2004 059068 | | 7/2004 |
| WO | 2004 085595 | | 10/2004 |

| | | | |
|---|---|---|---|
| WO | 2006 021760 | A1 | 3/2006 |
| WO | 2006021761 | A1 | 3/2006 |
| WO | 2006021773 | A1 | 3/2006 |
| WO | 2007 051989 | | 5/2007 |
| WO | 2007 083142 | A1 | 7/2007 |

OTHER PUBLICATIONS

International Search Report dated Nov. 11, 2005 for application PCT/GB2005/003259.
Written Opinion of the International Searching Authority for application PCT/GB2005/003259.
English-language abstract for EP 0906747 obtained online from the European Patent Office web site, "esp@cenet".
English-Language translation of EP 09 06 747 A2.
U.S. Appl. No. 12/092,612, filed May 5, 2008, published as US 2009-0235959 A1.
U.S. Appl. No. 12/160,909, filed Jul. 15, 2008, published as US 2009-0308414 A1.
U.S. Appl. No. 12/160,921, filed Jul. 15, 2008, published as US 2010-0065084 A1.
U.S. Appl. No. 12/447,571, filed Nov. 23, 2009, published as US 2010-0104488 A1.
U.S. Appl. No. 12/447,618, filed Mar. 22, 2010, published as US 2010-0179087 A1.
U.S. Appl. No. 12/447,527, filed Jan. 8, 2010, published as US 2010-0135874 A1.
U.S. Appl. No. 12/447,374, filed Dec. 14, 2009, published as US 2010-0089422 A1.
U.S. Appl. No. 12/447,353, filed Feb. 8, 2010, published as US 2010-0155428 A1.
U.S. Appl. No. 12/447,312, filed Jan. 13, 2010, published as US 2010-0170302 A1.
U.S. Appl. No. 12/092,634, filed Jun. 23, 2008, published as US 2008-0293604 A1.
U.S. Appl. No. 11/574,158, filed Jan. 4, 2008, published as US 2009-0044575 A1.
U.S. Appl. No. 11/574,047, filed Oct. 9, 2007, published as US 2009-0104093 A1.
U.S. Appl. No. 11/573,754, filed Aug. 27, 2007, published as US 2007-0295036 A1.
U.S. Appl. No. 12/749,061, filed Mar. 29, 2010, published as US 2010-0176148 A1.
U.S. Appl. No. 12/716,774, filed Mar. 3, 2010, published as US 2010-0212695 A1.
U.S. Appl. No. 29/353,880, filed Jan. 15, 2010.
U.S. Appl. No. 29/353,877, filed Jan. 15, 2010.
U.S. Appl. No. 12/601,891, filed Apr. 6, 2010, published as US 2010-0186781 A1.
U.S. Appl. No. 12/601,863, filed Apr. 6, 2010, published as US 2010-0200025 A1.
U.S. Appl. No. 11/574,051, filed Oct. 9, 2007, published as US 2008-0168804 A1.
U.S. Appl. No. 12/447,509, filed Oct. 21, 2009, published as US 2010-0031978 A1.
U.S. Appl. No. 11/573,954, filed Jan. 4, 2008, published as US 2008-0274025 A1.
U.S. Appl. No. 13/185,875, filed Jul. 19, 2011, not yet published.
U.S. Appl. No. 13/185,722, filed Jul. 19, 2011, published as US 2011-0272435 A1.
International Search Report PCT/GB2005/003271, Aug. 24, 2006.
Written Opinion PCT/GB2005/003271, Feb. 23, 2007.
Written Opinion PCT/GB2005/003265, Feb. 23, 2007.
International Search Report PCT/GB2005/003265, Mar. 2, 2006.
English Translation of application FR 2723751 taken from esp@net.com, Feb. 23, 1996.
English Translation application DE 19740819 Al taken from esp@net.com, Mar. 18, 1999.
English Translation application DE 19516312 C1 taken from esp@net.com, Aug. 8, 1996.
English Translation of EP 0906747 provided by esp@cenet, Apr. 7, 1999.
English Abstract of JP 2000-317350 taken from espa@cenet, Nov. 21, 2000.
English Abstract of JP 2003-260130 taken from espa@cenet, Sep. 16, 2003.
English Abstract of JP 2006-122196 taken from espa@cenet, May. 18, 2006.
English Abstract of KR 2002001154 cited by examiner in Office Action dated Oct. 26, 2011 of related U.S. Appl. No. 12/447,509, Jan. 9, 2002.
English Translation application DE 4400417 taken from esp@cenet.com, Jul. 13, 1995.

* cited by examiner

DETERGENT DISPENSING DEVICE

This is an application filed under 35 USC 371 of PCT/GB2005/003259.

The present invention is related to a detergent dispensing device, particularly for dispensing said detergent into an automatic dishwashing or washing machine over a plurality of washing cycles.

In automatic dishwashing machines, the detergent, whether in powder, tablet or gel form, is usually filled manually by the user into the machine, in particular into a detergent holder, before each dishwashing operation.

This filling process is inconvenient, with the problem of exact metering of the detergent and possible spillage thereof, for powder and gel detergents. Even with detergents in tablet form, wherein the problem of accurate dosing is overcome, there is still the necessity of handling the dishwashing detergent every time a dishwashing cycle is started. This is inconvenient because of the usually corrosive nature of dishwasher detergent compositions.

A number of devices are known for holding unit doses of a detergent composition or additive, such as detergent tablets, and for dispensing of such unit doses into a machine.

WO 01/07703 discloses a device for the metered release of a detergent composition or additive into a dishwashing machine having a number of separate sealed chambers for holding the detergent composition or additive and means for piercing the chambers, activated by conditions within the machine.

WO 03/073906 discloses a free standing device for dispensing multiple doses of detergent into a dishwasher. The device has a plate-like construction. A round blister pack having a plurality of doses arranged around its periphery is loaded into the pack. A winder is then rotated to load mechanical energy into the device sufficient to dispense more than one dose of detergent. A thermally operated latch then moves when the device is subjected to the elevated temperatures within the dishwasher and, in cooperation with a ratchet mechanism, moves the blister pack so that the next dose of detergent is ready for dispensing. In order to dispense the detergent, either the blister pack is pierced, or the dose is ejected from its compartment within the blister pack.

WO 03/073907 discloses a similarly shaped free standing dispensing device. In order to dispense detergent, a lever is manually operated to move a blister pack either to eject the detergent from a compartment within the blister pack, or to pierce the blister pack. A door or flap initially prevents wash liquor within the machine from accessing the exposed detergent. A bi-metallic strip is provided to move the door or flap when the device is exposed to the elevated temperatures during a washing cycle to allow access of the wash liquor to the exposed detergent thereby dispensing the detergent to the machine.

According to a first aspect of the present invention there is provided a cartridge for a detergent dispensing device for an automatic washing machine which dispenses a plurality of doses each in a successive washing cycle, the device having selecting means to selectively direct wash liquor to each dose, the cartridge having a substantially cylindrical configuration with a plurality of chambers, each chamber containing detergent and having a wash liquor inlet at the top of the cartridge in an upright configuration in which the axis of the cylinder is substantially vertical, and at least one outlet for detergent and wash liquor towards the bottom of the cartridge.

This provides a cartridge in which wash liquor can be directed to an inlet, and washes the detergent down through the chamber and out of the an outlet. This contrasts with the prior art in which there is no distinction between an inlet and an outlet. The wash liquor is simply arranged to flood a region containing the detergent. The present invention therefore provides a more efficient way of removing the detergent from the chambers.

Preferably each wash liquor inlet is provided with a weir. This ensure that, should a small amount of water inadvertently be directed to an unselected chamber, the weir will present a barrier to this water reaching the detergent. Only the significantly larger flow which will occur when a chamber is selected will be sufficient to pass the weir.

The outlet may be positioned in the bottom wall of the cartridge. It may be positioned in the side wall of the cartridge towards the bottom end. It may extend axially along the side wall, in which case it may either be an elongate slot, or may be a series of discrete openings. The outlet may alternatively be a combination of any of the above configurations.

Preferably the axial length of the cartridge is greater than its diameter. Such a cartridge will have a "cup-shape" configuration in contrast to the "plate-shape" configuration of the prior art. Such a cartridge is significantly less bulky than the prior art devices. It will therefore be more attractive to a consumer at point of purchase. It also has a benefit in use in that it takes up less space in the dishwasher occupying the place of a single cup, rather than one or more plates as in the prior art.

Each chamber is preferably substantially wedge shape as this maximises the space available for the detergent within the device. The wedge may be truncated at its inner edge to accommodate the selecting means. The detergent may be arranged to occupy the whole of the chamber when viewed in a radial plane. However, preferably, there is at least one axially extending path down through the chamber which is free from detergent. This path may take the form of a gap between a radially outermost edge of the detergent and a radially outer wall of the compartment. Alternatively or additionally one or more holes may extend down through the detergent itself.

Each chamber may be separated into a plurality of compartments, each having access to the inlet and outlet. Such an arrangement would be necessary if the detergent was a two-part product containing two components which are reactive with one another.

The present invention also extends to a detergent dispensing device comprising a cartridge according to the first aspect of the present invention and a selecting means to selectively direct wash liquor to the chambers.

Preferably, such a device has a common outlet from all of the chambers which only permits substantially uni-directional flow.

The outlet may be provided with a uni-directional valve to allow the uni-directional flow. However, the outlet is preferably provided with a tortuous path to allow the uni-directional flow as such a path can be readily built into the device during its manufacture, e.g. by moulding. Preferably the outlet has a plurality of baffles which serve to deflect liquid entering the outlet back out of the outlet.

Preferably, the cartridge is spaced from the outlet. Thus, should a small amount of wash liquor enter the outlet, this will be accommodated in the space thereby preventing it from entering an unselected chamber.

The selecting means may be any means by which the detergent in an adjacent chamber can be selected. For example, it may be a mechanism for piercing or peeling a film seal in a compartment.

The selecting means may be any mechanism for selectively exposing a chamber to the wash liquor within the machine. Preferably, however, the selecting means has an opening which is selectively alignable with each chamber. For example, the selecting means may comprise a film comprising the opening which is moved linearly or rotatably into alignment with a chamber. However, preferably, the selecting means comprises a spout which is rotatable into alignment with an opening to a respective chamber. This spout is preferably designed to block access of the wash liquor to unselected chambers.

Preferably, the device is provided with a funnel leading to the selecting means. This increases the amount of wash liquor which can be directed into a selected chamber.

The selecting means or cartridge may be movable manually. In other words, its movement is fully controlled by a user. Alternatively, the device may be fully automatic i.e. proceed to dispense a number of doses in successive wash cycles without any user intervention as disclosed, for example, in WO 01/07703 and WO 03/073906. Alternatively, the device may be "semi-automatic". In this case, some user intervention is necessary either to move the selecting means or cartridge which are then reset during operation of the machine. Alternatively, the user may reset the selecting means or cartridge which are then moved during operation of the machine.

In the case of the automatic or semi automatic device, the device is preferably arranged to react to a parameter (e.g. pH, water conductivity, water mass, door operation) which occurs during the operation of the washing machine.

Preferably, the device contains a thermally reactive element and the parameter is temperature. The thermally reactive element may be any of a memory metal/memory alloy, thermal bimetal, bimetal snap element, shape memory polymer or wax motor. The element is preferably designed to react at between 25° C. and 55° C. (more preferably 38° to 40°). The element may be designed to react as soon as possible which may be necessary if the device has been reset manually and must be moved automatically. However, if the device has been moved automatically and is reset by the thermal element, the thermal element preferably has a historisis effect.

This delays the operation of the thermal element to ensure that the device is not reset during the early part of the wash cycle of the machine, but is only reset once the machine has carried out the full washing process.

This can be achieved in a number of different ways.

The first with a thermal element may be designed such that it has a hysteresis (time and/or temperature based). Thus the thermal element is activated at the start of the wash cycle. However, (for a temperature hysteresis effect) the thermal element is designed such that the decreasing temperature between the wash cycle(s) and the rinse cycle(s) is not sufficient to de-activate the element, and so re-activation at the start of the rinse cycle cannot occur. In this case the thermal element preferably has an activation temperature of around 38° C. to 45° C. and a de-activation temperature of around 25° C. to 33° C.

For a time hysteresis effect the thermal element is designed such that it can only be activated once during a dishwasher cycle. Typically from 30 minutes to 2 hours.

A simulated temperature hysteresis effect may be achieved by providing a jacket around the thermal element. The jacket is intended to fill with hot wash liquor from the wash cycle. The jacket preferably has a small outlet aperture. The small outlet aperture means that during the relatively cool period between the wash and rinse cycle(s) the jacket retains the majority of the hot wash liquor, meaning that the thermal element is not de-activated during this cooler period.

A further hysteresis effect may be achieved mechanically. In this case, by use of, for example, a double ratchet mechanism, the thermal element is allowed to react to both of the temperature changes. However, a double ratchet mechanism means that only the first activation cycle causes a change to the opening of a chamber of the device; the second activation is nullified by the second ratchet.

For the wax motor the melting and solidification behaviour of the wax itself can be used for the hysteresis, because certain wax types show slow solidification compared to melting.

Also for the wax motor the hysteresis effect may be achieved by an water collector (having a small/slow water release aperture) which prevents the wax motor from the second movement by the weight of the collected water. The water collector preferably empties over 20 minutes to an hour.

If the chambers contain both wash detergent and rinse aid with both being intended to be released in to their respective cycle(s) the activation of the thermal element at both cycle(s) is advantageous.

Generally the automated component includes a reset mechanism to cover the eventuality that a consumer disrupts the operation of the automatic washing machine during a washing cycle.

In the case of either the manually operated device, or the "semi-automatic" device, the manually operated mechanism may either be configured to be operated by the hand of a user, or may be configured to be operated by the door of the machine.

Either the directing means or the cartridge may be arranged to be movable to select a dose of detergent. However, preferably, the directing means is arranged to be movable as this requires less energy than moving the cartridge filled with detergent.

The device is preferably for use in an automatic dishwasher. Accordingly the detergent most preferably comprises an automatic dishwasher detergent. Examples of which include conventional detergents, and the '2-in-1' and '3-in-1' variants. Most preferably the detergent comprises a solid. In the context of the present invention the term solid can be taken to include solidified gels as well as conventional solid materials (such as compressed particulate materials and solidify molten/cross linked materials).

The detergent formulation typically comprises one or more of the following components; builder, co-builder, surfactant, bleach, bleach activator, bleach catalyst, enzyme, polymer, dye, pigment, fragrance, water and organic solvent.

Optionally the detergent comprises a detergent additive. It will be appreciated that a detergent additive when compared to a detergent may be required during a different section of the dishwasher wash cycle (e.g. such as the rinse cycle for a rinse aid detergent additive).

Indeed successive chambers of the cartridge may be filled with different detergent compositions. For example a first chamber, intended to be dispensed in a wash cycle of a dishwasher may contain a 'wash formulation' and a second chamber, which may for convenience be located adjacent to the first chamber, may contain a rinse aid formulation for dispensing in a rinse cycle of an automatic dishwasher.

The chamber may be divided into sub-chambers, each of them being exposed to the washing liquor at once, to ensure stability of incompatible ingredients of the detergent (i.e. enzymes and bleach).

It will be appreciated that in the scenario as described in the preceding paragraph the first and second chambers may be sized differently to suit their different purposes.

The detergent may be added to the cartridge by any suitable method. The detergent may be added to the cartridge manually, by casting or by injection moulding.

A suitable injection moulding process is described in British Patent Application No 0323659.3 and British Patent Application No 0415786.3.

Preferably the device includes an indication mechanism to show how many chambers of the cartridge remain (i.e. are still full of detergent) so that a user has an idea of when a replacement is required. A preferred form of an indication mechanism comprises a marking on the cartridge which can be viewed by a consumer. The marking may comprises a series of numerals arranged in association with one or more of the chambers of the cartridge. Such a marking may require a window in order to be viewed by a consumer. Optionally the marking may be associated with a fixed marker so that the relevant part of the marking is clearly indicated.

Optionally the marking may employ a colour scheme (e.g. along the lines of a traffic light system with red meaning that only a small number of chambers remain, yellow an intermediate number and green a large number of chambers remain.

Generally the device includes an "end-of-life" indicator to show when the cartridge has been used. Normally the "end-of-life" indicator provides two functions: firstly it high-lights to the consumer that the cartridge needs replacing and secondly it prevents further activation of the cartridge.

The "end-of-life" indicator may be a part of the indication mechanism (as discussed above). Alternatively it may comprise a separate indicator.

Usually the "end-of-life" indicator is deactivated when a new/replacement cartridge is added to the device. The deactivation may be automatic or require manual input.

Figure 1B:
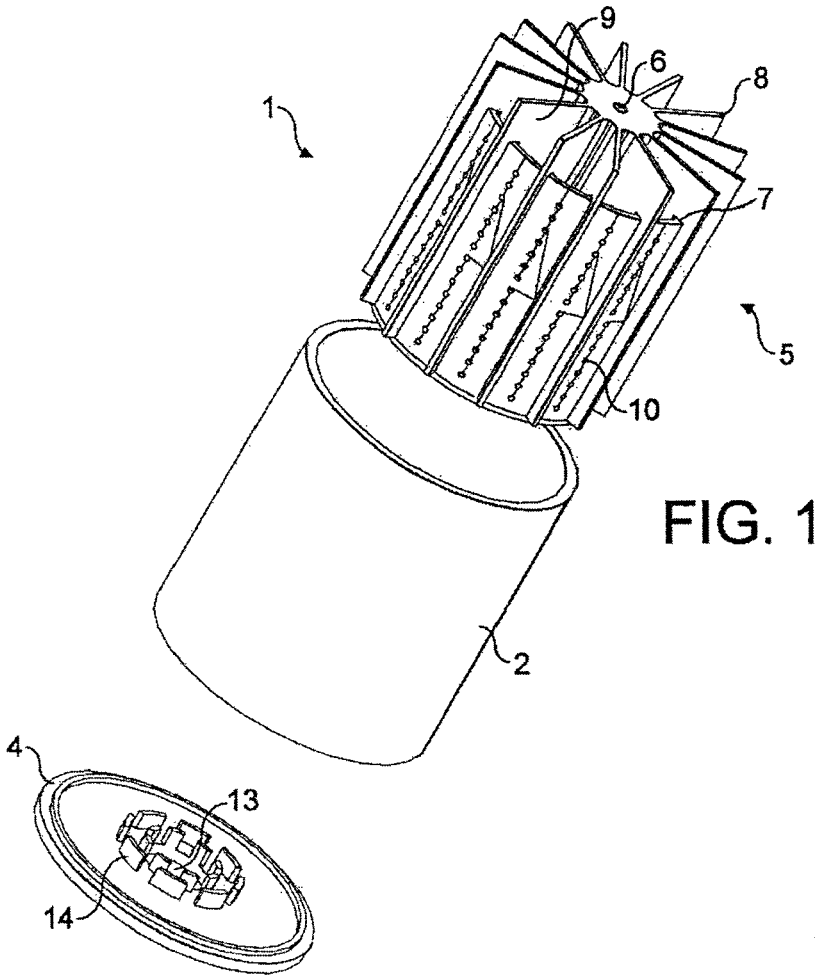
Figure 1C:
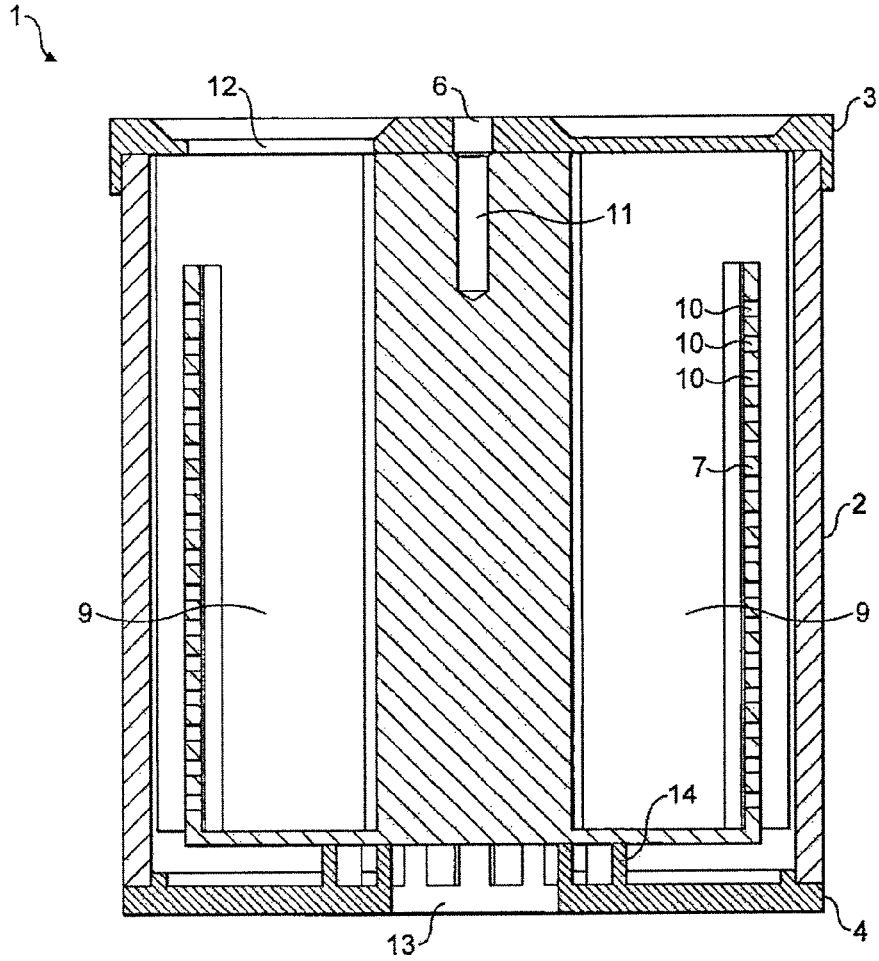
Figure 2A:
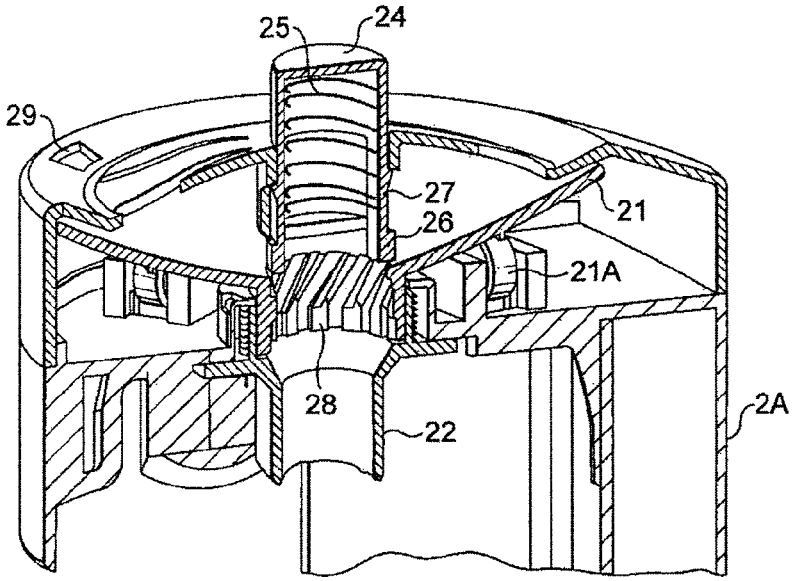
Figure 2B:
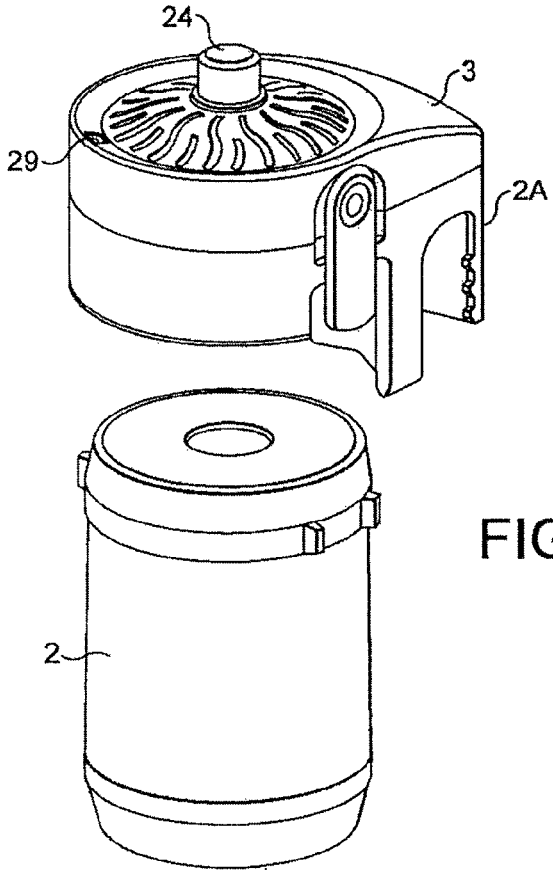

Examples of cartridges and devices in accordance with the present invention will now be described with reference to the accompanying drawings, in which:

FIGS. 1(*a*), 1(*b*) and 1(*c*) are perspective, exploded perspective and cross-sectional side views of a first embodiment of a detergent dispensing device in accordance with the present invention;

FIGS. 2(*a*) to 2(*c*) are perspective and cross-sectional perspective views of a second embodiment of a detergent dispensing device in accordance with the present invention;

FIGS. 3(*a*) to 3(*d*) are perspective and cross-sectional perspective views of a third embodiment of a detergent dispensing device in accordance with the present invention;

FIGS. 4(*a*) to 4(*e*) are perspective and cross-sectional perspective views of a fourth embodiment of a detergent dispensing device in accordance with the present invention;

FIGS. 5(*a*) to 5(*e*) are perspective and cross-sectional perspective views of a fifth embodiment of a detergent dispensing device in accordance with the present invention;

The device of the present invention may be a free standing device removably insertable into a dishwasher, or may be built into a dishwasher, e.g. into the door.

FIGS. 1(*a*) to 1(*c*) show a detergent dispensing device 1. The device 1 comprises a housing 2 which is in the form of a cylinder having a lid 3 and a base 4.

Disposed within the housing 2 is a cartridge 5. The cartridge 5 is also based on a cylinder. The cartridge 5 has a central hub 6 and an outer periphery 7. Arranged at regular intervals are a plurality of limbs 8 which extend from the hub 6 to the periphery 7. The limbs 8 serve as to divide the centre of the cartridge 5 into a plurality of wedge shape chambers 9. The limbs 8 extend up to lid 3 so as to separate the chambers from one another. In the diagram as shown there are fourteen chambers 9 clearly it will be appreciated that the number of changes may be different from that shown.

The chambers are intended to be filled with a detergent composition (not shown).

The periphery 7 of each chamber 9 has a plurality of drainage apertures 10.

The lid 3 is rotatable relative to the remainder of the housing 2 and the cartridge 5. The lid 3 has a spindle 11 which co-operates with the hub 6 of the cartridge 5. The lid incorporates a inlet aperture 12, which serves, in use, as to direct wash liquor into a particular chamber of the cartridge 5.

In use the lid is arranged such that the inlet aperture 12 is arranged adjacent to an appropriate chamber 9. This may be done entirely manually or by the use of an automatic component as described in later examples. The device 1 may then be inserted into an automatic washing machine (such as an automatic dishwasher). In use the wash liquor is directed through the inlet aperture 12 into an adjacent chamber 9. The incoming wash liquor contacts any detergent present within the chamber 9 and washes the detergent out of the chamber 9 through one of the drainage apertures 10. The thus loaded wash liquor flows through the space between the cartridge 5 and the housing 2 and leaves the housing 2 through a uni-directional dispense aperture 13, which is, in use, in the bottom of the housing.

As shown the uni-directional dispense aperture 13 achieves this function by an arrangement of baffles 14, these baffles 14 allow the detergent loaded liquor to be dispensed from the device 1 under the action of gravity. However any wash liquor entering the device 1 through aperture 13 is generally deflected back through aperture 13 by the baffles. The general downward flow through the device also serves to wash out any such unwanted flow. A clearance is provided between the bottom of the cartridge 5 and the base 4 so that the detergent in unselected chambers is held away from the liquid in the bottom of the housing (either unwanted backflow or flow through the selected chamber).

FIGS. 2(*a*) to 2(*c*) show a second embodiment of a detergent dispensing device 1. Like the first embodiment the housing 2 and the cartridge 5 are circular/cylindrical. The housing 2 has a clip 2A for attachment to a basket within the machine to maintain the device upright. The cartridge has a similar configuration to that of the first example, with the differences being set out below. The main difference compared to the first example is that the manually rotatable lid 3 has been replaced by a more sophisticated mechanism.

The cartridge 5 is not rotatable relative to the lid 3. Instead to allow access of wash liquor to the chambers 9 the device comprises a collecting funnel 21 which co-operates with a rotatable directing spout 22.

In operation incoming wash liquor is collected in the funnel 21 and allowed to flow to the directing spout 22. The directing spout 22 has a spout outlet 23 which directs wash liquor to a single chamber 9. For successive wash cycles/successive operations both the funnel 21 and the directing spout 22 are rotated relative to the cartridge 5 so that a successive chamber 9 can be accessed.

To effect rotation of the funnel 21 a user depresses an operating button 24 against a bias spring 25. Upon depression of the operating button 24, lugs 26, on arms 27, dependent from the button 24 engage with slots 28 disposed within a central opening of the funnel 21. The button 24 is non-rotatably mounted in the lid 3 and since the slots 28 are inclined at an angle from the vertical axis of the hub 6, depression of the button 24 causes rotation of the funnel 21 (and the associated directing spout 22) within the housing 2 supported on bearing wheels 21A.

The rotation of the funnel 21 within the housing 2 is such that a successive chamber 9 of the cartridge 5 may be accessed by incoming wash liquor, (i.e. the slots 28, the lugs 26 and the arms 27 are arranged such that full depression of the operating button 24 causes rotation of the funnel 21 such that a successive chamber 9 is brought into an operational position).

To aid the user in knowing how many chambers of the cartridge 5 remain the lid 3 includes a window 29. Through the window 29 a user can view a portion of the funnel 21. The viewed portion preferably contains numerals associated with the number of the chamber 9 in use or number or chambers 9 remaining (i.e., chambers 9 which still contain detergent).

The bias spring 25 preferably comprises a bimetallic material. In use, when the button 24 is depressed before the wash cycle commences, the button 24 does not return to its original position. This non-return function aids the prevention of accidental multiple operation of the device 1. Towards the end of the wash cycle as the temperature increases in the rinse and/or drying cycle, the spring 25 is activated returning the button 24 to its original position.

When the button 24 returns to its original position, reverse rotation of the funnel 21 is prevented by two mechanisms. Firstly, a ratchet mechanism (not shown) prevents rotation. Secondly, preferably the arms 27 are resilient, such that on upward movement the arms bend inwards and do not engage the slots 28.

When the last chamber 9 of the cartridge 5 is placed in its operational position the directing spout 22 engages an 'end-stop' so that the funnel 21 cannot rotate any further. In this position if the button 24 is operated the lugs 26 simply ride over the slots 28 by virtue of flexing of the arms 27.

When the last chamber 9 has been used the cartridge 5 can be replaced by a user.

Figure 2C:
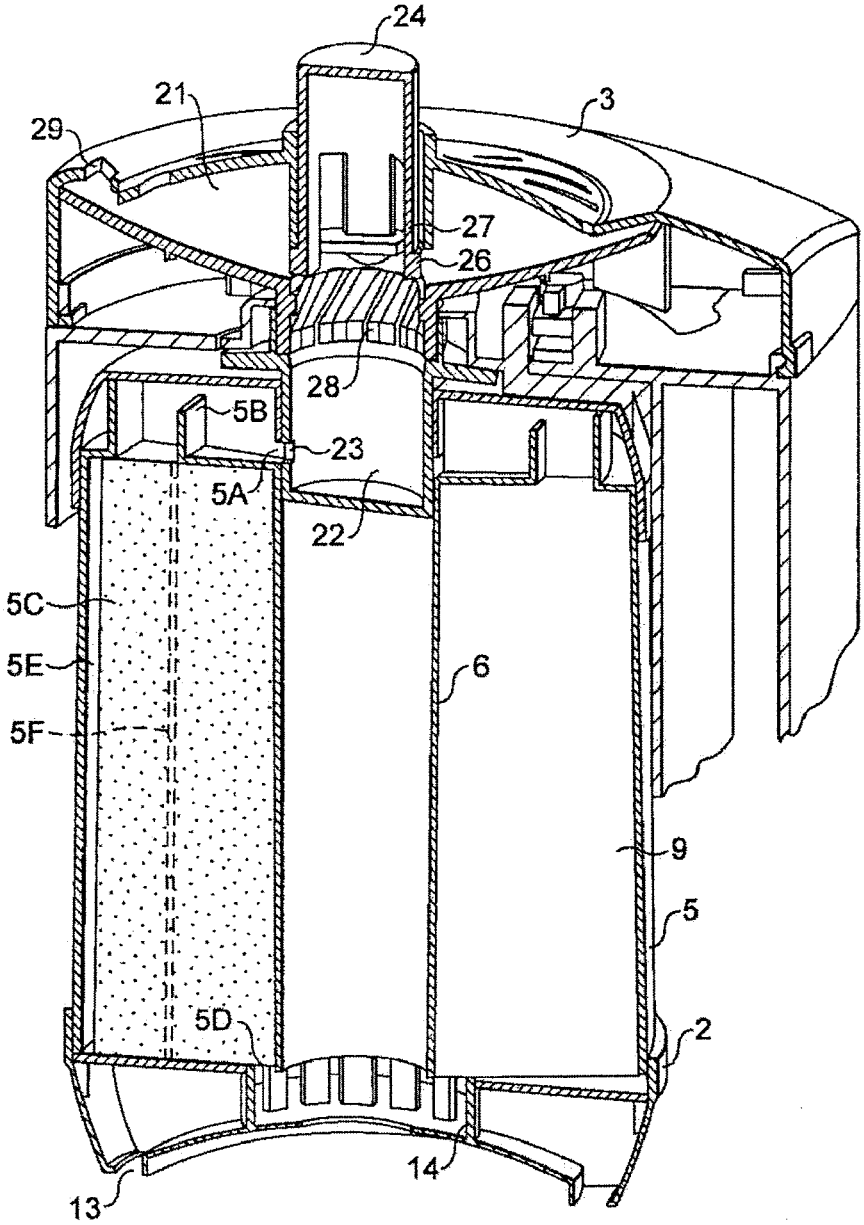
Figure 3A:
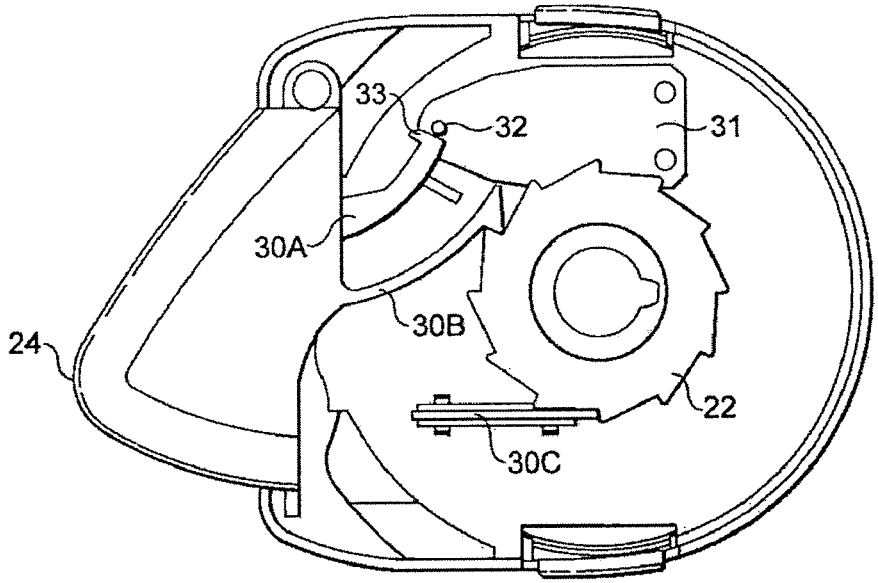
Figure 3B:
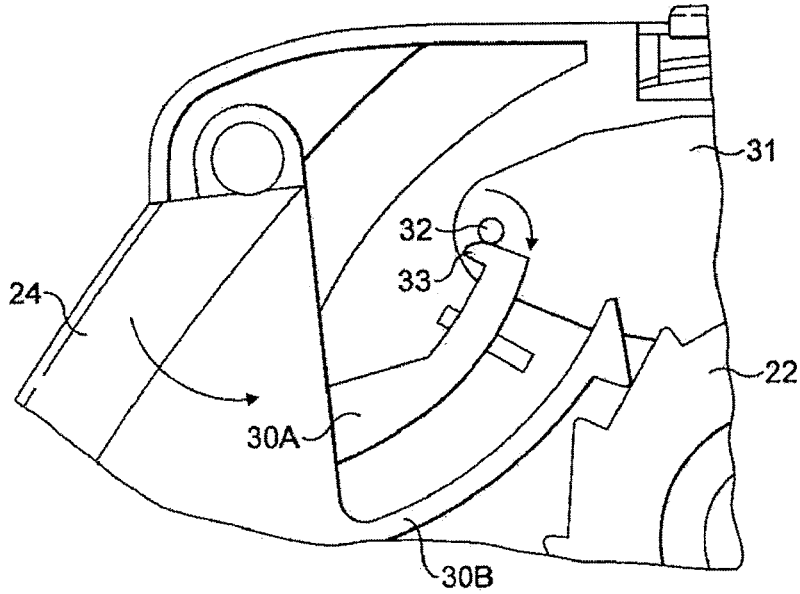
Figure 3C:
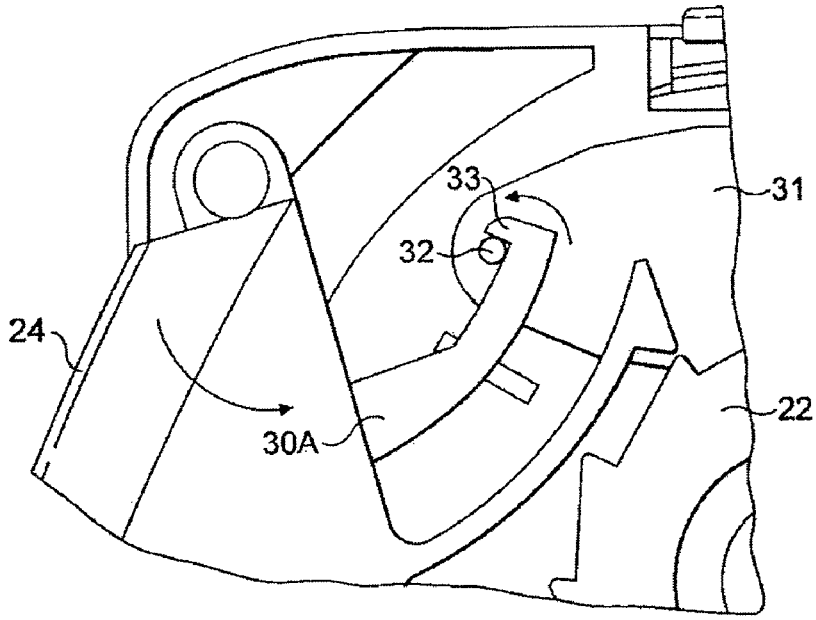
Figure 3D:
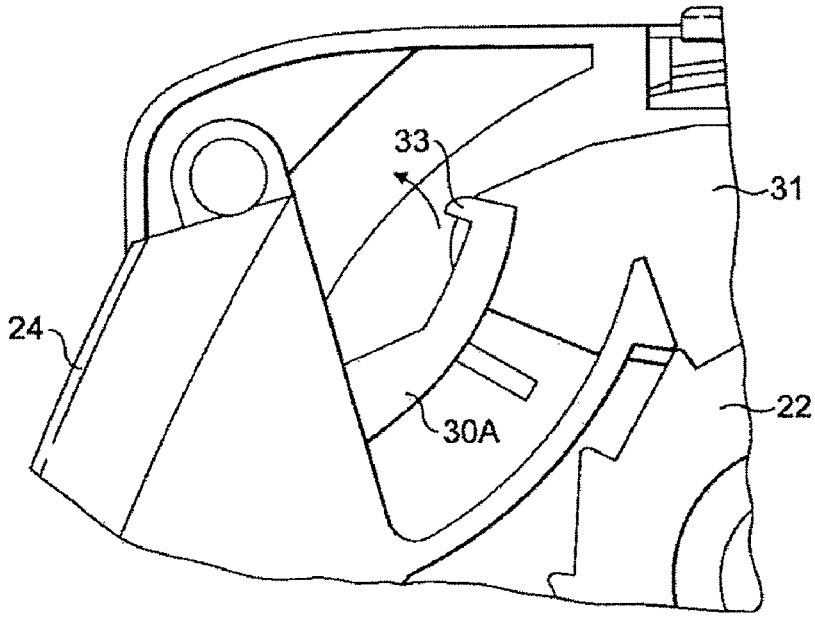
Figure 4A:
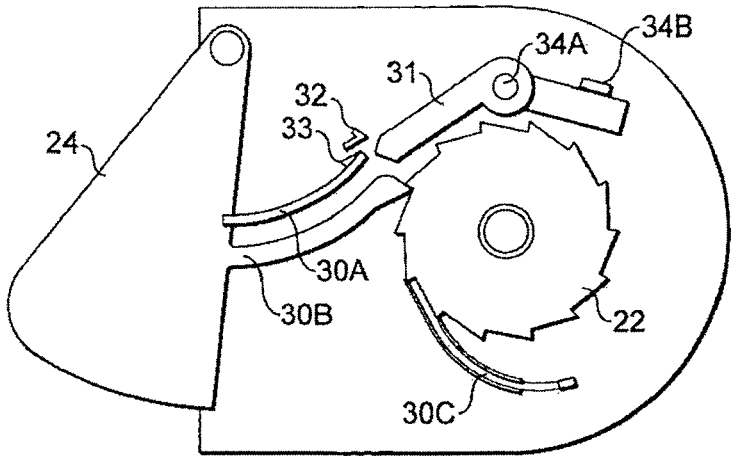
Figure 4B:
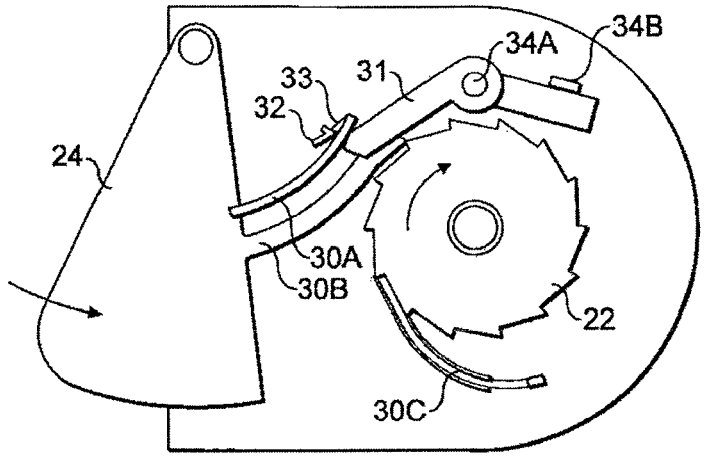
Figure 4C:
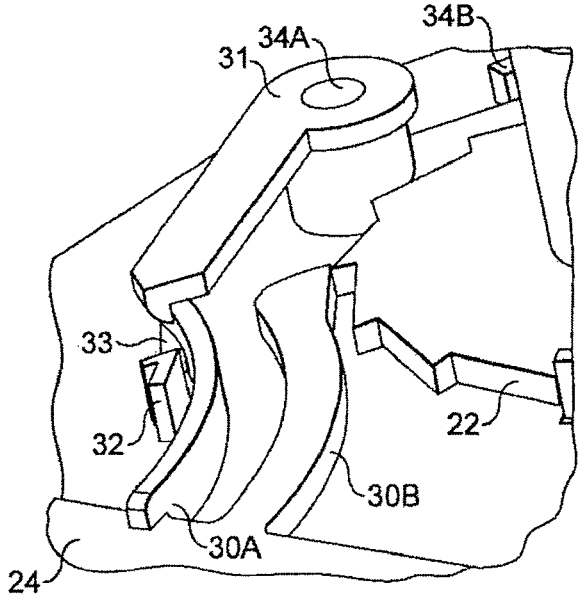
Figure 4D:
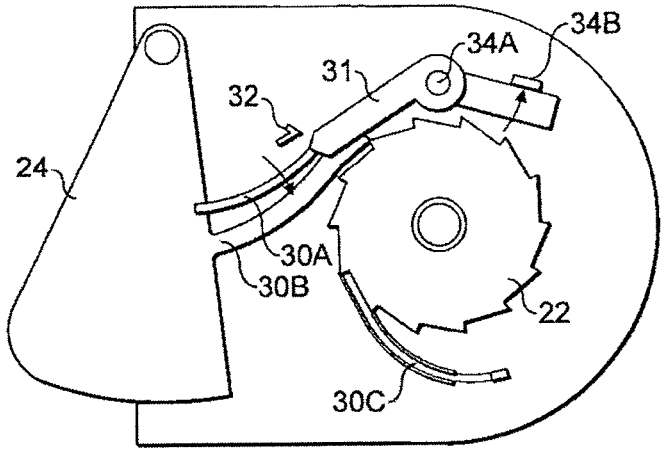
Figure 4E:
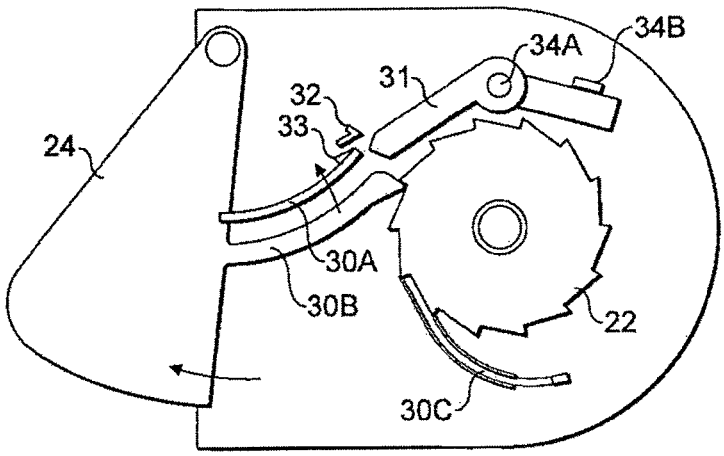
Figure 5A:
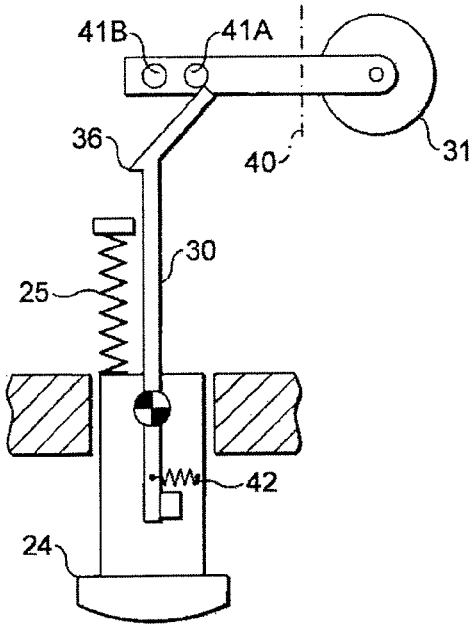
Figure 5B:
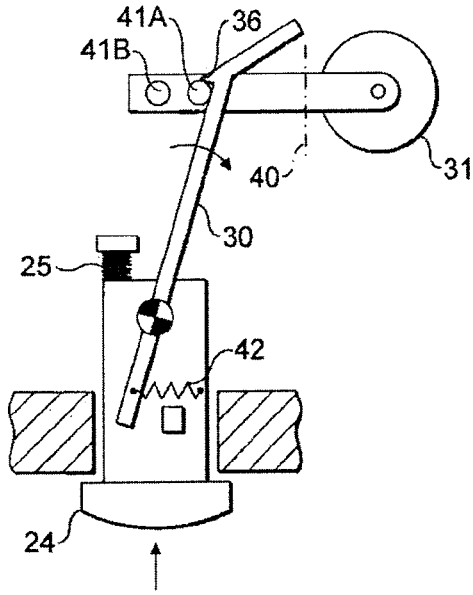
Figure 5C:
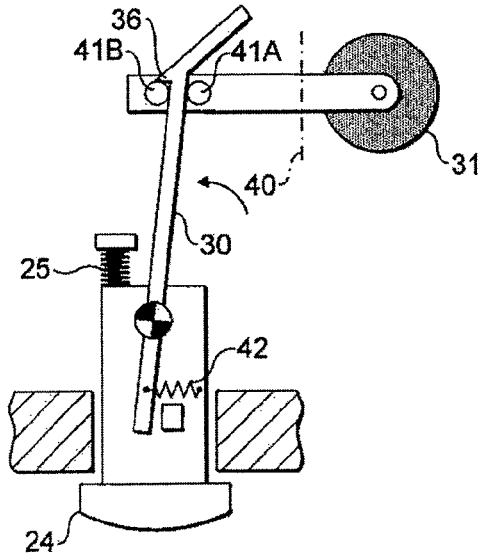
Figure 5D:
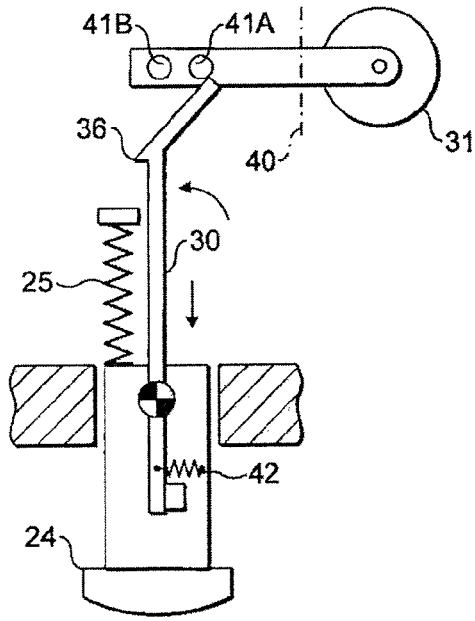
Figure 5E:
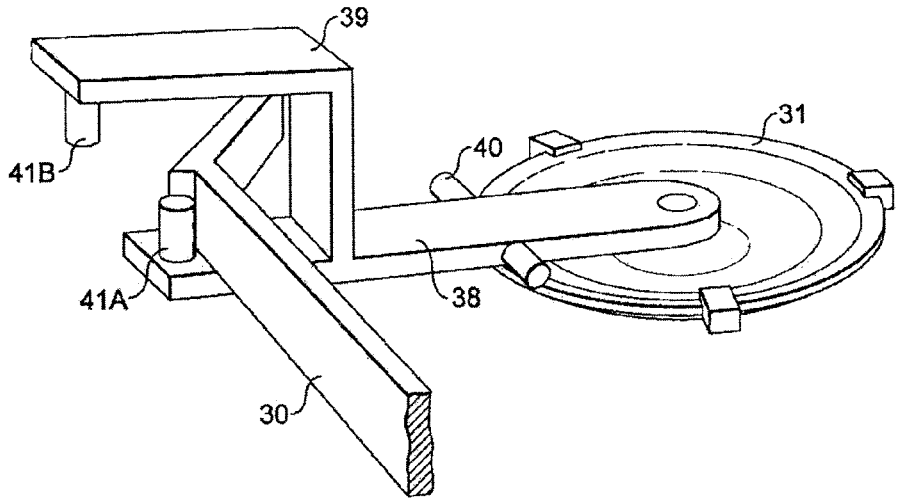

As is apparent from FIG. 2*c*, the cartridge 5 is configured differently from that of FIG. 1. In particular, the inlet 5A to each chamber 9 is no longer at the end wall of the cartridge, but is instead at the top of a radially inwardly facing wall facing the hub 6 so as to be aligned with the spout 22. A weir 5B is provided between the inlet 5A and the detergent 5C to prevent small amounts of water which may be directed to an unselected chamber 9, from coming into contact with the detergent. In place of the axially spaced drainage apertures 10 is a single aperture 5D in the bottom face of the chamber. In order to assist the general flow of the wash liquor through the chamber 9, there is a space 5E between the radially outermost edge of the detergent 5C and the inner wall of cartridge 5. Further, one or more axially extending through holes 5*f* are provided in the detergent to facilitate flow.

Also, to provide a uni-directional flow out of the bottom of the device, the outlet 13 is now towards the outer periphery of the device and is radially offset by considerable amount in relation to the outlets 5D. Also, baffles 14 will direct any unwanted back flow through outlet 13.

FIGS. 3(*a*)-3(*d*) show a third embodiment of a detergent dispensing device 1. Like the first and second embodiments the housing 2 and the cartridge 5 are circular/cylindrical. This device has a similar spout and cartridge to that of the second embodiment. However, the manner in which the button is operated is different.

The device 1 has a directing spout 22 in the form of a ratchet (the directing spout 22 preferably co-operates with a collecting funnel 21 (not shown but as described in FIGS. 2A to 2D). The directing spout has a spout outlet. In operation incoming wash liquor is collected in the funnel and allowed to flow via the directing spout. For successive wash cycles/successive operations the directing spout 22 is rotated relative to the cartridge 5 so that a successive chamber 9 can be accessed.

The operation is explained with reference to a sequence of events from FIGS. 3(*b*) to 3(*d*). The button 24 is designed to be operated by engagement with a dishwasher door rather than the hand of an operator as in FIGS. 2*a* to 2*d*. This device will need to be positioned within the machine so that the door presses the button as it closes.

In FIG. 3(*b*) the dishwasher door is open and the dishwasher is cold. In this state the user can fill the dishwasher with houseware, opening and closing the dishwasher door as often as is necessary to fully load the dishwasher.

The first time that the dishwasher door is closed the operating button 24 is depressed (the button 24 is spring biased away from the device) and is retained in a depressed condition by virtue of a first arm 30A (see FIG. 3(*c*)).

A first arm 30A operates in conjunction with a bimetallic strip 31. The bimetallic strip 31 is in the form of a blade mounted on the lid 3. The bimetallic strip 31 has a rod 32 extending from its non-mounted end.

The first arm 30A terminates in a flange 33.

When the door is closed (thus moving the button 24 towards the device 1) the arm 30A is moved inward towards the bi-metallic strip 31. The flange 33 passes behind and engages the rod 32. This engagement locks the operating button 24 in position: further opening of the dishwasher door cannot cause movement of the button 24.

As shown in FIG. 3(*d*) the dishwasher operation has begun. As a result of the operation (elevated temperature) the bimetallic strip 31 is altered to its high temperate state. This has the effect that the rod 32 moves away from the first arm 30A until it no longer engages flange 33.

As the flange 33 is no longer engaged by rod 32 the arm 30*a* moves sideways. The operating button 24 is now free to move once the dishwasher door is opened. Thus when the dishwasher door opens the button 24 is moved away from the device by a return spring (not shown).

A second arm 30B (attached to the button 24), in the form of a lever pawl engages the directing spout 22. Outward movement of the button 24, and attached arm 30B caused further movement of the directing spout 22. In this way the orientation of the directing spout 22 is altered such that a new chamber 9 of the cartridge 5 is put in to an operational position for the next dishwasher cycle.

If the dishwasher is not open for some time (and thus cools down) re-engagement of the rod 32 and the flange 33 (potentially caused by the movement of the bimetallic strip 31 back to its low temperature configuration) is prevented by the movement of the arm 30A past the rod 32.

A third arm 30C provides a biasing force against the spout 22 to prevent reverse rotation of the spout when the second arm 30B is disengaged from the spout.

When all the chambers 9 of the cartridge 5 have been used further movement of the directing spout 22 (and hence the cartridge 5) is prevented by engagement of a lug (not shown) on the directing spout 22 with a pawl (not shown).

FIGS. 4(*a*) to 4(*e*) show a fourth embodiment of a detergent dispensing device 1.

The fourth embodiment is very similar to the third embodiment. Only the material differences will be described in detail. Again, the detergent cartridge is as described previously.

The main differences are the operation of the arms 30A and 30B and the operation of the bimetallic strip 31.

The operation is explained with reference to a sequence of events from FIGS. 4(*a*) to 4(*e*).

In FIG. 4(*a*) the dishwasher is cold and the dishwasher door is open.

In FIG. 4(*b*) the dishwasher door is closed. The arm 30B engages the directing spout 22 and rotates the directing spout 22, bringing a new chamber 9 of the cartridge 5 into an operating position.

Also shown in FIG. 4(*b*) a flange 33 on arm 30A engages a rod 32 in the lid 3. This engagement of the flange 33 with the rod 32 prevents further movement of the button 24, in the event that the dishwasher door is opened, e.g., during the wash cycle.

The device 1 comprises a bimetallic strip 31 in the form of a bent rod, the rod being looped around and mounted around a first mounting 34*a* and abutting against a second mounting 34*b*.

During the wash cycle as the temperature in the machine increases the bimetallic strip 31 changes to its high temperature configuration passing arm 30*a* and dropping down behind it to engage the flange 33 (FIGS. 4(*c*) and 4(*d*)).

As the machine cools after the wash cycle the bimetallic strip 31 returns to its low temperature configuration. In doing so it disengages the flange 33 from the rod 32 (FIG. 4(*e*)). With the disengagement the button 24 is free to move away from the device 1. Thus the arm 30B is moved relative to the directing spout 22 such that the device 1 is ready for the next operation.

FIG. 5(*a*)-5(*e*) show a variant of a thermal control arrangement that can be used with a device of the present invention.

The arrangement comprises an operating button 24 (which can be manually operated or door operated) linked to an arm 30. The arm 30 may operate an element of the device 1 or may simply provide a restriction on the operation of the button 24. The arm has a heel 36.

A bimetallic element 31 (here in the form of a snap disc) has a frame 37 associated therewith.

The frame 37 comprises an arm 38 and a jaw 39.

The frame arm 38 is connected to the centre of the snap disc 31. Along a portion of the frame arm 38 is disposed a pivot 40. At the other end of the frame arm 38 is the jaw 39.

The jaw 39 is disposed around the heel portion 36 of the arm 30. The jaw 39 has a lower tooth 41A and an upper tooth 41B which are intended to interact with the heel 36. The upper tooth 41B is disposed further from the pivot 40 than the lower tooth 41A.

In use the button 24 is depressed against a spring bias 25. This causes movement of the arm 30 relative to the jaw 39 such that the heel 36 engages at the lower tooth 41A (against a spring bias 42). As a result of this engagement the button 24 is retained in its activated position regardless of whether the dishwasher door is opened and/or a user attempts further activation.

As the dishwasher machine operates the temperature of the dishwasher and hence the overall device 1 increases. With this temperature increased the snap disc 31 alters to its high temperature configuration. This alteration raises the section of the frame arm 38 which is connected to the snap disc 31. The other end of the frame arm 38 is lowered (pivoting about axis 40) and thus the jaw 39 is lowered. This has the effect that the engagement of the heel 36 with a lower tooth 41A is severed. The heel 36 then engages the upper tooth 41B, the heel being pushed towards the upper tooth 41B by the spring bias 42.

As the dishwasher cycle is completed and the dishwasher cools (possibly aided by opening of the dishwasher door) the snap disc 31 reverts to its lower temperature configuration. This has the effect that the upper tooth 41B is raised away from the heel 36 until the heel 36—upper tooth 41B engagement is broken.

Since the heel 36 encounters no further retaining force the spring bias working against the button 24 is able to push the button 24 back to its inactivated position.

The invention claimed is:

1. A cartridge for a detergent dispensing device for an automatic washing machine adapted to dispense a plurality of doses each in a successive washing cycle, the device having selecting means to selectively direct wash liquor to each dose:

the cartridge having a substantially cylindrical configuration with a plurality of chambers, each chamber containing detergent and having a wash liquor inlet located at a top end of the cartridge in an upright configuration in which a major axis of the cartridge is substantially vertical, and at least one outlet for detergent and wash liquor located towards a bottom end of the cartridge in the upright configuration, wherein the cartridge has at least one path that extends along the major axis through each chamber containing detergent, wherein the path is free from detergent and adapted to facilitate flow of load wash liquor from the cartridge;

wherein the path is provided by a gap between a radially outermost edge of the detergent and wall of the cartridge and/or wherein one or more holes extend axially through the detergent to provide the path.

2. A cartridge according to claim 1, wherein the wash liquor inlet is provided with a weir.

3. A cartridge according to claim 1, wherein the at least one outlet is positioned in a bottom wall of the cartridge.

4. A cartridge according to claim 1, wherein the at least one outlet is positioned in a side wall of the cartridge towards the bottom end of the cartridge.

5. A cartridge according to claim 1, wherein the at least one outlet is positioned axially along a side wall of the cartridge.

6. A cartridge according to claim 1, wherein an axial length of the cartridge is greater than a diameter of the cartridge.

7. A cartridge according to claim 1, wherein each chamber is substantially wedge-shaped.

8. A cartridge according to claim 1, wherein each chamber is separated into a plurality of compartments, wherein each compartment has access to the wash liquor inlet and the at least one outlet.

9. A detergent dispensing device comprising a cartridge according to claim 1, and a selecting means adapted to direct wash liquor into a selected chamber of the cartridge to contact the detergent composition therein.

10. A device according to claim 9, wherein the device further comprises a common outlet from the device in communication with all outlets from the cartridge, wherein the common outlet is adapted to only permit substantially uni-directional flow.

11. A device according to claim 10, wherein the common outlet is provided with a tortuous path to allow the substantially uni-directional flow.

12. A device according to claim 10, wherein the common outlet has a plurality of baffles that is adapted to deflect liquid entering the at least one outlet back out of the at least one outlet.

13. A device according to claim 10, wherein the cartridge is spaced from the common outlet.

14. A device according to claim 9, wherein the selecting means has an opening which is selectively alignable with each chamber.

15. A device according to claim 14, wherein the selecting means comprises a spout which is rotatable into alignment with an opening to a selected chamber.

16. A device according to claim 15, wherein the spout is arranged to block access of the wash liquor to unselected chambers.

17. A device according to claim 9, wherein the device is provided with a funnel leading to the selecting means.

18. A device according to claim 9, wherein the selecting means or cartridge are movable manually to select an adjacent chamber.

19. A device according to claim 9, wherein the selecting means or cartridge are automatically movable to select an adjacent chamber.

20. A device according to claim 9, wherein user intervention is necessary either to move the selecting means or cartridge which are then reset during operation of the machine.

21. A device according to claim 9, wherein user intervention is necessary to reset the selecting means or cartridge which are then moved during operation of the machine.

22. A device according to claim 19, wherein the device is arranged to react to a parameter which occurs during the operation of the washing machine.

23. A device according to claim 22, wherein the device contains a thermally reactive element and the parameter is temperature.

24. A device according to claim 18, wherein the device is be configured to be operated by the hand of a user.

25. A device according to claim 18, wherein the device is configured to be operated by the door of the machine.

26. A device according to claim 9, wherein the selecting means is arranged to be movable and the cartridge is stationary.

27. A cartridge according to claim 1, wherein the detergent consists of a solid.

28. A cartridge according to claim 27, wherein the solid of the detergent is selected from the group consisting of solidified gels or solid materials.

29. A cartridge according to claim 28, wherein the solid materials of the detergents are selected from the group consisting of compressed particulate materials and solidified molten/cross linked materials.

* * * * *